US007347522B2

(12) United States Patent
Kubo

(10) Patent No.: US 7,347,522 B2
(45) Date of Patent: Mar. 25, 2008

(54) INK-JET HEAD AND IMAGE RECORDING APPARATUS

(75) Inventor: Tomoyuki Kubo, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 258 days.

(21) Appl. No.: 11/321,174

(22) Filed: Dec. 28, 2005

(65) Prior Publication Data

US 2006/0139391 A1 Jun. 29, 2006

(30) Foreign Application Priority Data

Dec. 28, 2004 (JP) ..... P2004-380708

(51) Int. Cl.
*B41J 29/377* (2006.01)
*B41J 2/175* (2006.01)

(52) U.S. Cl. ..... 347/18; 347/58; 347/59

(58) Field of Classification Search ..... 347/18, 347/56–59, 47–49, 68
See application file for complete search history.

(56) References Cited

U.S. PATENT DOCUMENTS 5,841,452 A * 11/1998 Silverbrook ..... 347/47
5,850,234 A * 12/1998 Kneezel et al. ..... 347/18
6,007,176 A * 12/1999 Askren et al. ..... 347/18
2004/0189730 A1 9/2004 Kubo

FOREIGN PATENT DOCUMENTS

JP 2004-291342 10/2004

* cited by examiner

*Primary Examiner*—Lam Son Nguyen
(74) *Attorney, Agent, or Firm*—Reed Smith LLP

(57) ABSTRACT

An ink-jet head which includes: a flow passage unit having plural nozzles and pressure chambers respectively communicating with the nozzles, the pressure chambers being arranged along a planar surface; an energy transfer unit which is fixed to the planar surface and transfers ejection energy to ink in the pressure chambers; a driver IC which generates a driving signal supplied to the energy transfer unit; a flat flexible cable in which the driver IC is mounted and plural wirings that make connection between the driver IC and the energy transfer unit are formed; and a heat transfer body which sandwiches at least a part of the energy transfer unit between the heat transfer body and the planar surface of the flow passage unit, the heat transfer body having a thickness in a direction perpendicular to the planar surface, the thickness decreasing in a direction away from the driver IC.

11 Claims, 9 Drawing Sheets

INK-JET HEAD AND IMAGE RECORDING APPARATUS

CROSS REFERENCE TO RELATED APPLICATION

This application claims priority from Japanese Patent Application No. 2004-380708, filed on Dec. 28, 2004, the entire subject matter of which is incorporated herein by reference.

TECHNICAL FIELD

Aspects of the present invention relate to an ink-jet head for ejecting ink to a recording medium and performing printing.

BACKGROUND

A recording apparatus for performing printing by ejecting ink on a recording medium from a head unit (ink-jet head) including a piezoelectric actuator disposed in a recording head part while a carriage is equipped with the recording head part and the carriage is reciprocated is disclosed in JP-A-2004-291342. In this recording apparatus, a heat sink for radiating heat of a driver element (driver IC) is disposed in the recording head part and the head unit is fixed in a lower surface of the heat sink. An opening is disposed in a position opposed to the head unit of the heat sink. By this configuration, space is formed over the head unit and heat of the driver element becomes resistant to transfer to the head unit through the heat sink. Therefore, even when the heat sink becomes a high temperature, operating characteristics of the piezoelectric actuator of the head unit do not vary greatly. Further, a heat radiation body which is brought into contact with the piezoelectric actuator and does not make contact with the heat sink is disposed inside the opening of the heat sink. As a result of this, heat generated in the piezoelectric actuator itself is radiated and the head unit can be prevented from becoming a high temperature because of heat generation of the head unit itself.

SUMMARY

However, in the recording apparatus disclosed in JP-A-2004-291342, the heat sink and the head unit are fixed, so that the heat transferred from the driver element to the heat sink and the radiation heat from the driver element are transferred to the head unit and the heat radiation body; Since this heat transferred to the head unit and the heat radiation body becomes higher with a region nearer to the driver element, a temperature difference between a region near to the driver element and a region distant from the driver element occurs in the head unit and the heat radiation body. As a result of this, a large difference occurs in ink temperatures between plural cavities (pressure chambers) and nozzles, and variations in characteristics of ink eject from the nozzles occur.

Aspects of the invention provide an ink-jet head capable of reducing ink temperature differences between pressure chambers and nozzles caused by heat generated by a driver IC.

According to an aspect of the invention, there is provided an ink-jet head including: a flow passage unit having a plurality of nozzles and a plurality of pressure chambers respectively communicating with the nozzles, the pressure chambers being arranged along a planar surface of the flow passage unit; an energy transfer unit which is fixed to the planar surface of the flow passage unit and transfers ejection energy to ink in the plurality of pressure chambers; a driver IC which generates a driving signal supplied to the energy transfer unit; a flat flexible cable in which the driver IC is mounted and a plurality of wirings that make connection between the driver IC and the energy transfer unit are formed; and a heat transfer body which sandwiches at least a part of the energy transfer unit between the heat transfer body and the planar surface of the flow passage unit, the heat transfer body having a thickness in a direction perpendicular to the planar surface, the thickness decreasing in a direction away from the driver IC.

According to this aspect, when the heat transfer body is heated by heat generation of the driver IC, a region of the heat transfer body near to the driver IC becomes more resistant to heating than a region distant from the driver IC. As a result of that, a temperature difference between the regions with different distances from the driver IC becomes small in the heat transfer body, and an ink temperature difference between the pressure chambers of the flow passage unit and an ink temperature difference between the nozzles of the flow passage unit become small. Therefore, variations in characteristics of ink eject from the nozzles can be suppressed.

BRIEF DESCRIPTION OF THE DRAWINGS

Illustrative aspects of the invention may be more readily described with reference to the accompanying drawings.

DETAILED DESCRIPTION

Aspects of the invention will be described below with reference to the drawings.

Figure 1:
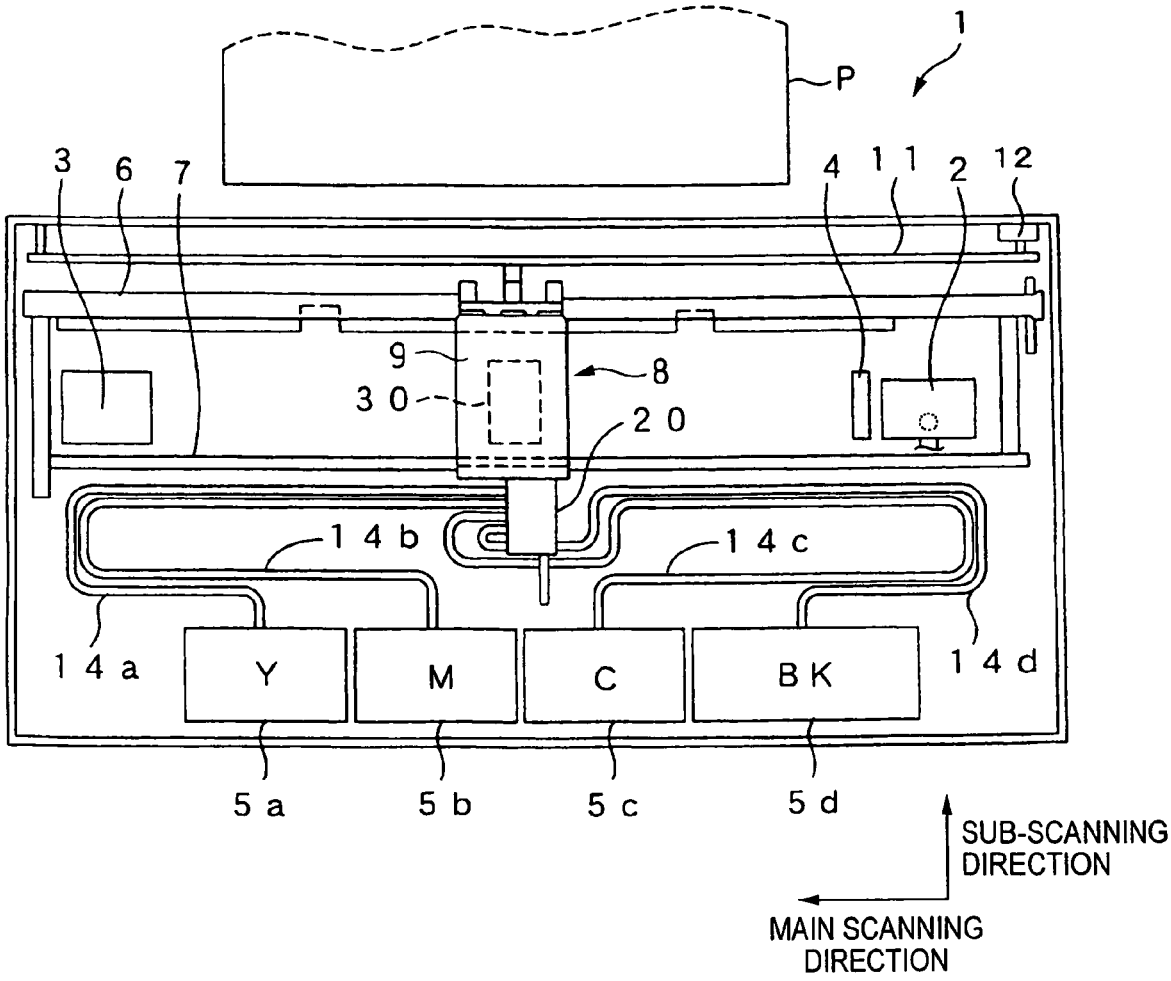
FIG. 1 is a schematic plan view of an ink-jet printer in which an ink-jet head according to a first aspect of the invention is adopted.

FIG. 1 is a schematic plan view of an ink-jet printer in which an ink-jet head according to a first aspect of the invention is adopted. Two guide shafts 6, 7 are disposed inside an ink-jet printer 1 as shown in FIG. 1. A head unit 8 also used as a carriage is attached to these guide shafts 6, 7. The head unit 8 includes a head holder 9 made of synthetic resin material. An ink-jet head 30 for ejecting ink to a print sheet P and doing-printing-is held in the head holder 9. The head holder 9 is attached to an endless belt 11 rotated by a carriage motor 12, and reciprocates in a main scanning direction along the guide shafts 6, 7 by driving of the carriage motor 12.

The ink-jet printer 1 includes an ink cartridge 5*a* in which yellow ink is received, an ink cartridge 5*b* in which magenta ink is received, an ink cartridge 5*c* in which cyan ink is received, and an ink cartridge 5*d* in which black ink is received. Each of the ink cartridges 5*a* to 5*d* is connected to a tube joint 20 by flexible tubes 14*a* to 14*d*, respectively. Also, an ink absorption member 3 opposed at the time when the head holder 9 moves to the left end is disposed in the ink-jet printer 1. The ink absorption member 3 absorbs ink ejected from a nozzle at the time of flushing. Also, a purge device 2 opposed at the time when the head holder 9 moves to the right end is disposed in the ink-jet printer 1. The purge device 2 absorbs ink from the nozzle at the time of purging. A wiper 4 for wiping the ink adhering to a nozzle surface is disposed in the left of the purge device 2.

Figure 2:
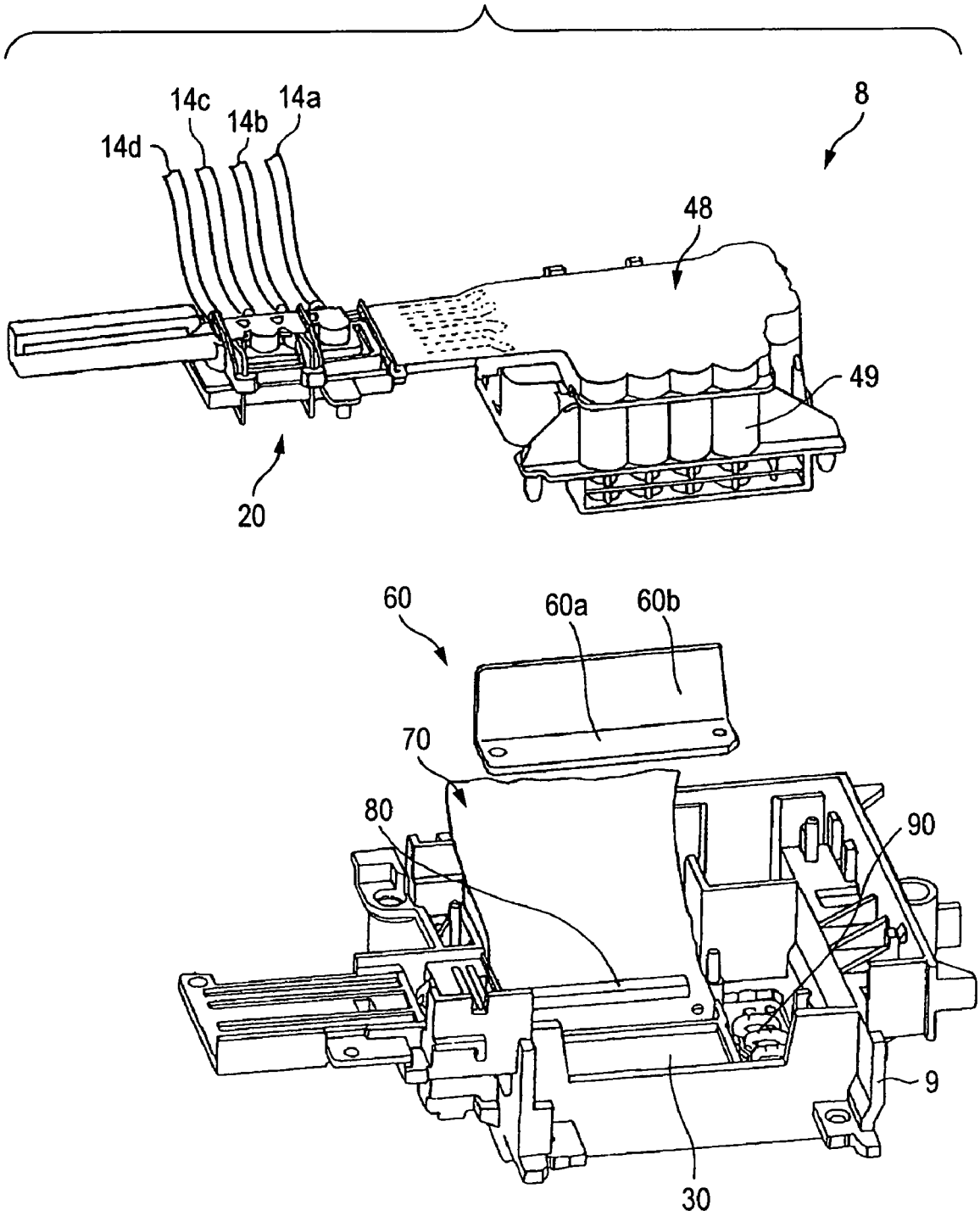
FIG. 2 is an exploded perspective view of a head unit shown in FIG. 1.
Figure 3:
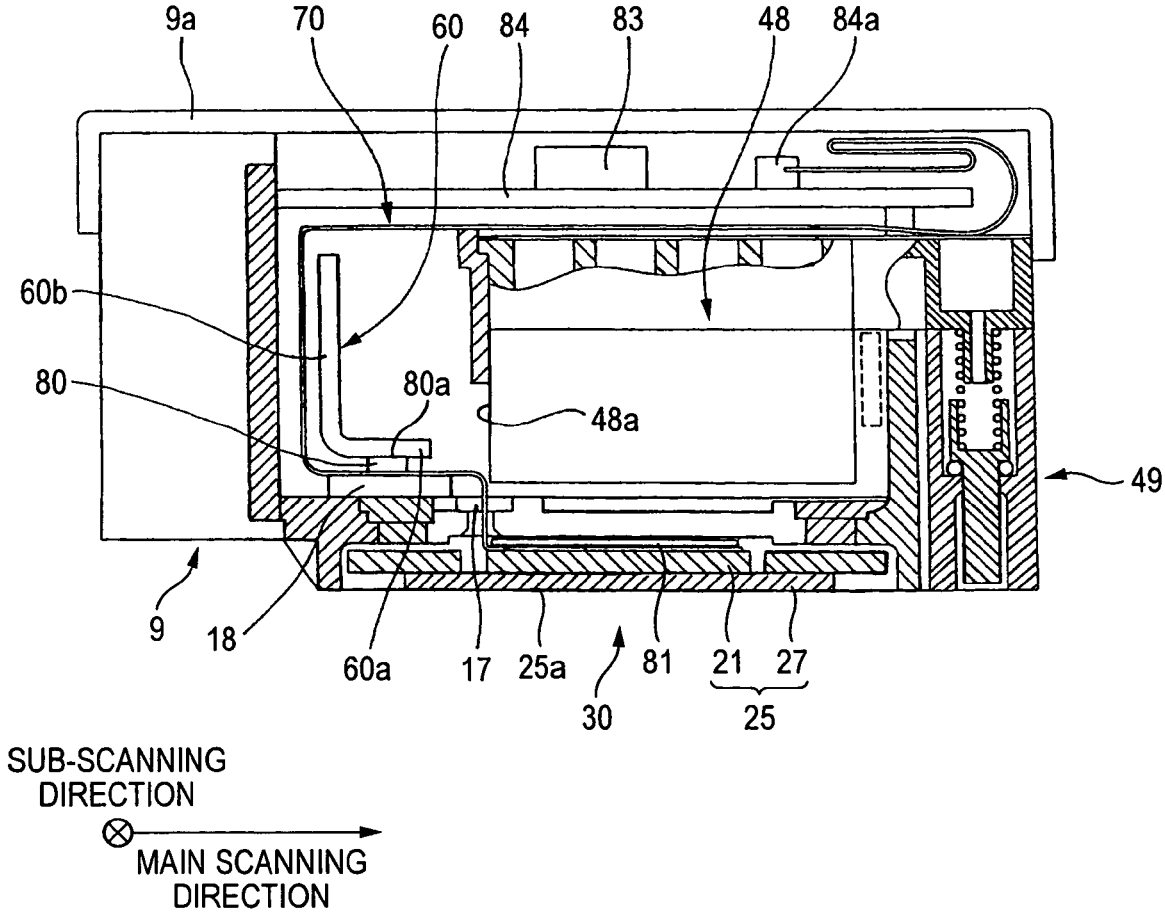
FIG. 3 is a longitudinal sectional view of the head unit shown in FIG. 2.

Subsequently, a main structure of the head unit 8 will be described below. FIG. 2 is an exploded perspective view of the head unit 8 shown in FIG. 1, and shows a state in which a buffer tank 48 and a heat sink 60 are detached from the head holder 9. FIG. 3 is a longitudinal sectional view of the head unit shown in FIG. 2.

As shown in FIGS. 2 and 3, the head holder 9 is formed in an approximately box shape opened upward and in its bottom, a head body 25 included in the ink-jet head 30 is fixed. Also, in the head holder 9, the buffer tank 48 for temporarily storing ink supplied to the head body 25 is installed in an upper portion of the head body 25. The head body 25 is installed so that a nozzle surface (bottom) 25*a* in which plural nozzles 28 are formed is exposed to the lower outside of the head holder 9 (see FIG. 5).

As shown in FIG. 2, the tube joint 20 for supplying ink to this buffer tank 48 is connected to the end of the buffer tank 48. Four ink flow outlets (not shown) are disposed in a lower surface of the buffer tank 48 and are connected to four ink supply vents 30*a* (described below) disposed in the head body 25 through a sealing member 90. A control board 84 in which a connector 84*a* and electronic components such as a capacitor 83 are mounted is disposed in an upper portion of the buffer tank 48. An upper portion of the control board 84 is covered with a cover 9*a* for covering an upper portion of the head holder 9.

In the head holder 9, the heat sink 60 is fixed in a position adjacent to a left sidewall 48*a* of the buffer tank 48 as shown in FIG. 3. The heat sink 60 has a horizontal part 60*a* extending in the right and left directions in FIG. 3 and a vertical part 60*b* upward standing from one end of the horizontal-part 60*a*. As shown in FIG. 2, both of the horizontal part 60*a* and the vertical part 60*b* are formed in horizontally long plate shape and a plate surface of the inside of the vertical part 60*b* is opposed to the sidewall 48*a* of the buffer tank 48. An exhaust device 49 for exhausting air accumulated inside the buffer tank 48 to the outside is disposed in the right of the buffer tank 48.

Figure 4:
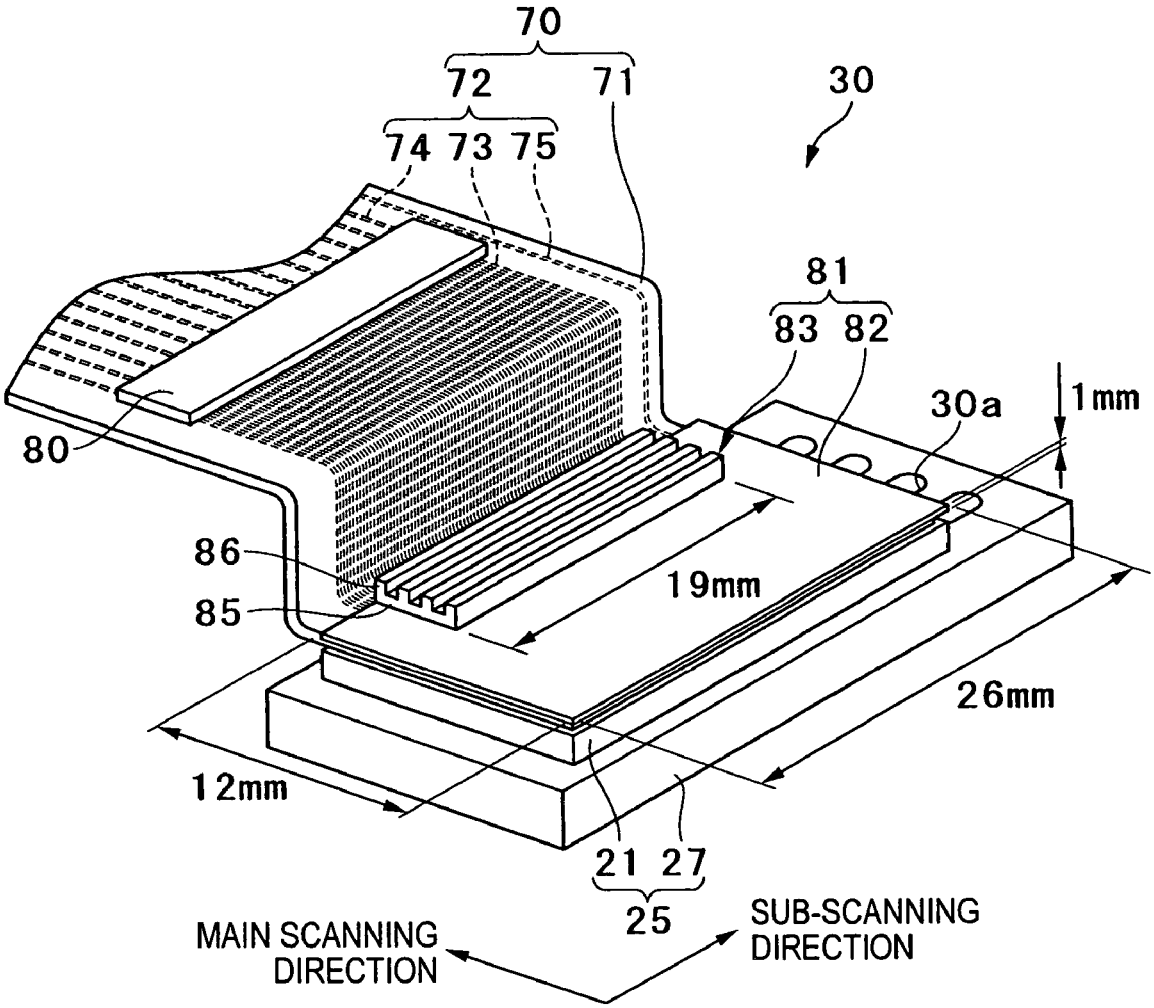
FIG. 4 is an outward appearance perspective view showing the ink-jet head according to the first aspect of the invention.

Next, a main configuration of the ink-jet head 30 will be described below. FIG. 4 is an outward appearance perspective view showing the ink-jet head 30 according to the first aspect of the invention. As shown in FIGS. 3 and 4, the ink-jet head 30 includes the head body 25 and a flexible printed circuit (FPC) 70 joined to an upper surface of the head body 25. The head body 25 includes a flow passage unit 27 in which plural ink flow passages are formed for each color, and a piezoelectric actuator (energy transfer means) 21 bonded to an upper surface of the flow passage unit 27 by a thermosetting adhesive. Both of the flow passage unit 27 and the piezoelectric actuator 21 are constructed by laminating plural thin plates having rectangular planar shape and are placed in a lower portion of the buffer tank 48. Four ink supply vents 30*a* whose planar shape is elliptic shape are formed in the upper surface of the flow passage unit 27 so as to avoid the piezoelectric actuator 21. A filter 55 in which plural minute holes are formed in a position opposed to each of the ink supply vents 30*a* is placed in a region in which these four ink supply vents 30*a* are formed (see FIG. 5). Thus, the ink flowing out of ink flow outlets (not shown) of the buffer tank 48 is filtered by the filter 55 and flows from the ink supply vents 30*a* into the flow passage unit 27.

As shown in FIG. 4, the FPC 70 has a substrate 71 extending from the piezoelectric actuator 21 to the control board 84, and plural wirings 72 formed along an extending direction of the substrate 71. A driver IC 80 is mounted on the substrate 71. The plural wirings 72 have plural individual wirings 73 for making electrical connection between the driver IC 80 and plural individual electrodes 37 (described below) formed in the piezoelectric actuator 21, plural signal lines 74 for making electrical connection between the driver IC 80 and the control board 84, and common wiring 75 for connecting a common electrode 38 (described below) formed in the piezoelectric actuator 21 to a ground. Incidentally, the plural individual wirings 73 are formed every corresponding individual electrode 37, so that the number of individual wirings 73 is larger than the number of plural signal lines 74. The FPC 70 is drawn from an upper surface of the piezoelectric actuator 21 to one direction of the main scanning direction, and passes through a hole 17 formed in the bottom of the head holder 9, and turns upward through a gap formed between the vertical part 60*b* and a sidewall of the head holder 9 as shown in FIG. 3. Then, the FPC 70 is electrically connected to the connector 84*a* disposed on the control board 84 through a gap between the control board 84 and the buffer tank 48. The driver IC 80 converts a print signal serially transmitted from the control board 84 into a parallel signal corresponding every individual electrode 37 of the piezoelectric actuator 21, and outputs a driving signal converted into a predetermined electric potential to the individual wirings 73 connected to each of the individual electrodes 37. Also, the FPC 70 is pressed so that an upper surface of the driver IC 80 makes contact with the horizontal part 60*a* of the heat sink 60 by an elastic member 18 placed in a position opposed to the driver IC 80. As a result of this, the excessive heat of the driver IC 80 which generates heat can be radiated.

Also, a heat transfer body 81 is placed in a region opposed to the piezoelectric actuator 21 of the FPC 70. The heat transfer body 81 includes an aluminum plate 82 with a constant thickness and a rectangular planar shape of the size approximately equal to that of an upper surface of the piezoelectric actuator 21, and a heat radiation body 83 joined to an upper surface of the aluminum plate 82. The heat radiation body 83 in the present aspect is constructed of aluminum. The heat radiation body 83 extends along a sub-scanning direction and is placed in the end of the side of the driver IC 80 in the upper surface of the aluminum plate 82. In the heat radiation body 83, four protrusions 86 upward protruding from the bottom portion 85 are formed and separated mutually in the main scanning direction. Each of the protrusions 86 extends along the sub-scanning direction so that all the cross sections along the main scanning direction of the heat radiation body 83 have the same shape. Thus, in the heat transfer body 81, by the heat radiation body 83, a thickness of a region (which is a region in which the aluminum plate 82 is covered with the heat radiation body 83 in the aspect) near to the driver IC 80 becomes thicker than a thickness of a region (which is a region in which the aluminum plate 82 is exposed in the aspect) distant from the driver IC 80 and similarly, the surface area increases.

Incidentally, the form of protrusions is not limited as herein described. The protrusion near to the driver IC may be larger than the protrusion distant from the driver IC. Also, the protrusions may be arranged more densely at the region near to the driver IC than the region distant from the driver IC.

Figure 5:
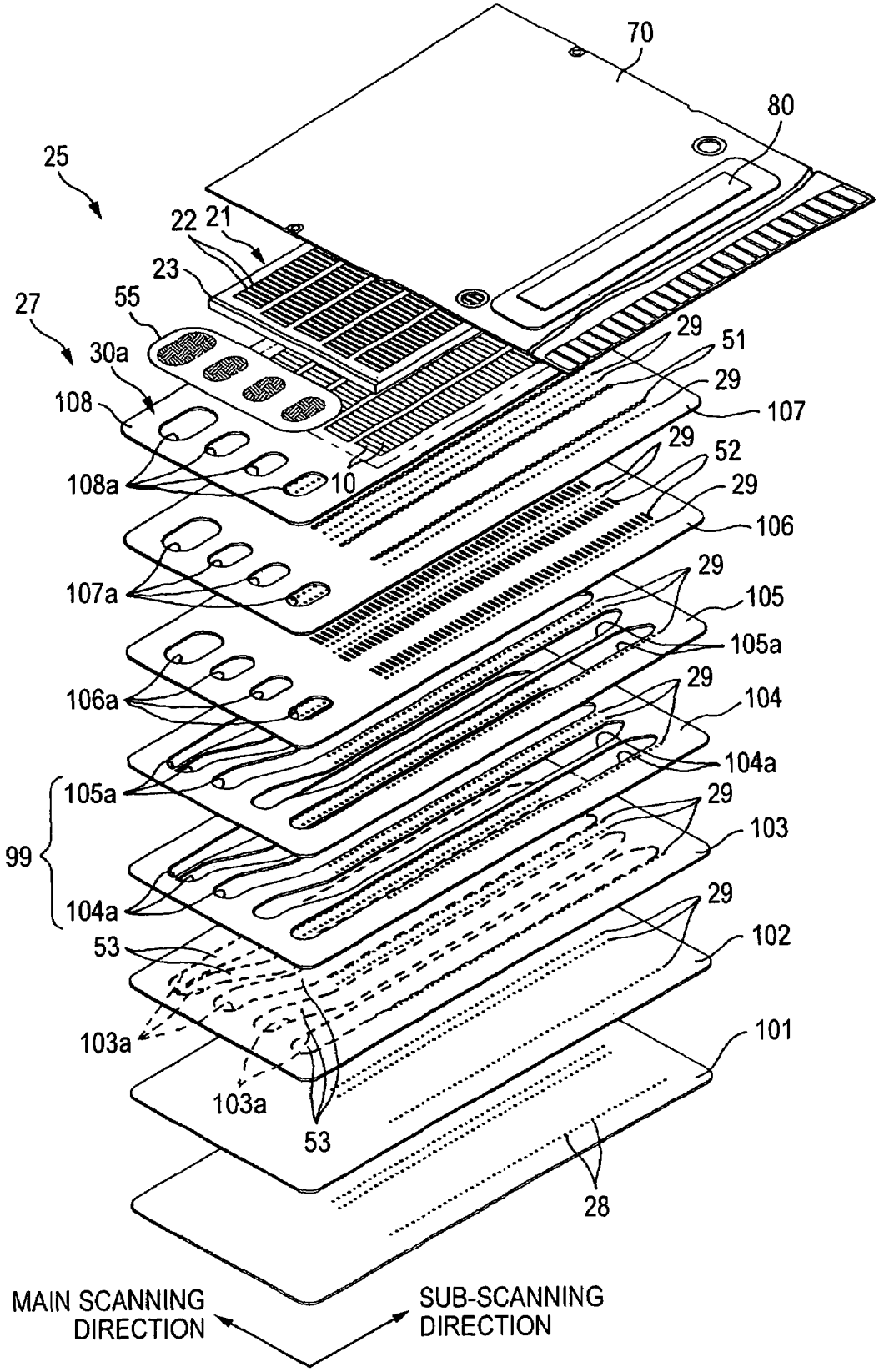
FIG. 5 is an exploded perspective view of a head body and an FPC shown in FIG. 4.

FIG. 5 is an exploded perspective view of the head body 25 and the FPC 70. As shown in FIG. 5, the flow passage unit 27 has a lamination structure in which a total of eight sheet materials of a cavity plate 108, a supply plate 107, an aperture plate 106, two manifold plates 104, 105, a damper plate 103, a coverplate 102 and a nozzle plate 101 are laminated from above. Each of the plates 101 to 108 has a rectangular planar shape having a longitudinal direction in the sub-scanning direction. In the aspect, seven plates excluding the nozzle plate 101 among the eight plates 101 to 108 constructing the flow passage unit 27 are made of stainless steel and the nozzle plate 101 is made of polyimide resin.

Many nozzles 28 with minute diameters are bored at minute distances in the nozzle plate 101. These nozzles 28 are arranged in five rows in a staggered arrangement shape along a longitudinal direction (sub-scanning direction) of the nozzle plate 101.

Plural pressure chambers 10 corresponding to each of the nozzles 28 are bored in the cavity plate 108 in five rows in staggered arrangement along a longitudinal direction of the cavity plate 108. A longitudinal direction of each of the pressure chambers 10 is orthogonal to the longitudinal direction of the cavity plate 108. One end of each of the pressure chambers 10 communicates with the nozzle 28 in the nozzle plate 101 via through holes 29 with minute diameters bored in staggered arrangement in the supply plate 107, the aperture plate 106, the two manifold plates 104, 105, the damper plate 103 and the cover plate 102. Also, in the side of one end of the cavity plate 108, four holes 108*a* used as the ink supply vents 30*a* are formed and separated along a transverse direction (main scanning direction) of the cavity plate 108.

As shown in FIG. 5, in the manifold plate 105 of the side near to the aperture plate 106 among the two manifold plates 104, 105, five ink chamber half parts 105*a* are formed in a through state. These five ink chamber half parts 105*a* extend along a longitudinal direction of the manifold plate 105 and also are separated mutually in a transverse direction of the manifold plate 105.

On the other hand, also in the manifold plate 104 of the side of the damper plate 103, five ink chamber half parts 104*a* similar to the five ink chamber half parts 105*a* are formed in a through state. By laminating a total of four sheets of the two manifold plates 104, 105, the aperture plate 106 and the damper plate 103 in this configuration, the two ink chamber half parts 104*a*, 105*a* opposed are joined mutually and upper and lower openings formed at this time are covered with the upper aperture plate 106 and the lower damper plate 103. As a result of this, a total of five common ink chambers 99 are formed outside and between rows of the through holes 29. Incidentally, one ends of the common ink chambers 99 are respectively opposed to the ink supply vents 30*a*.

In the supply plate 107, plural communication holes 51 are formed in a through state in addition to the plural through holes 29. These communication holes 51 communicate with the pressure chambers 10 in one opening and communicate with apertures 52 described below in the other opening. Further, the plural communication holes 51 are arranged in five rows of staggered shape along a longitudinal direction of the supply plate 107 in correspondence with each of the pressure chambers 10. Also, the supply plate 107 has four holes 107*a* in one end side of the longitudinal direction as shown in FIG. 5. These holes 107*a* are respectively formed so as to be opposed to the four holes 108*a* of the cavity plate 108.

In the aperture plate 106, apertures 52 with substantially rectangular planar shapes extending along a transverse direction of the aperture plate 106 are arranged in five rows of staggered shape along a longitudinal direction of the aperture plate 106 in addition to the plural through holes 29. The apertures 52 communicate with the communication holes 51 in one end and communicate with the common ink chambers 99 in the other end. The apertures 52 are means in which the cross-sectional area of a direction orthogonal to an ink fluid direction is slightly small and a flow of ink which tends to flow back into the side of the common ink chambers 99 from the pressure chambers 10 at the time of ejecting ink is limited. Also, in the aperture plate 106, holes 106*a* are formed in positions respectively opposed to the four holes 107*a*. Each of the holes 106*a* respectively communicates with the holes 107*a* in one opening and respectively communicates with the corresponding common ink chambers 99 in the other opening.

Incidentally, the one hole 106*a* located at the most backward portion in FIG. 5 among the four holes 106*a* communicates with the two common ink chambers 99 of a backward portion in FIG. 5, and the other three-holes 106*a* respectively communicate with the three common ink chambers 99 of a forward portion in FIG. 5. That is, ink from the one ink supply vent 30*a* is respectively supplied to the two common ink chambers 99 located at the backward portion in FIG. 5, and ink from the corresponding one ink supply vent 30*a* is respectively supplied to the other three common ink chambers 99. In the aspect, ink of black is supplied to the two common ink chambers 99 of the backward portion in FIG. 5, and inks are supplied to the three common ink chambers 99 located from the forward portion toward the backward portion in FIG. 5 in order of yellow, magenta and cyan.

Five rows of damper grooves 103*a* are recessed in the damper plate 103 as shown in FIG. 5. These damper grooves 103*a* are formed so as to be opened toward only the cover plate 102, and the position and shape are the same shape as the common ink chambers 99. Therefore, in the case of joining the manifold plates 104, 105 and the damper plate 103, damper parts 53 are located in a portion opposed to the common ink chambers 99 of the damper plate 103. Here, the damper parts 53 are constructed as the bottoms of recesses formed of stainless steel capable of being elastically deformed properly, so that the damper parts 53 can freely vibrate to the side of the common ink chambers 99 and the side of the damper grooves 103*a*. By such a configuration, even when fluctuations in pressure occurring in the pressure chambers 10 at the time of ejecting ink propagate to the common ink chambers 99, the damper parts 53 are elastical deformed inresponse to the fluctuations and thereby the fluctuations can be absorbed and damped.

By such a configuration of the flow passage unit 27, plural ink flow passages ranging from the ink supply vents 30*a* to the nozzles 28 through the common ink chambers 99, the apertures 52, the communication holes 51, the pressure chambers 10 and the through holes 29 sequentially are constructed inside the flow passage unit 27. Ink flowing from the buffer tank 48 into the flow passage unit 27 through the ink supply vents 30*a* is once stored in the common ink chambers 99. Then, the ink is supplied to each of the pressure chambers 10 through the apertures 52. The ink to which pressure is applied by the piezoelectric actuator 21 in each of the pressure chambers 10 is ejected from the corresponding nozzles 28 via each of the through holes 29.

Figure 6:
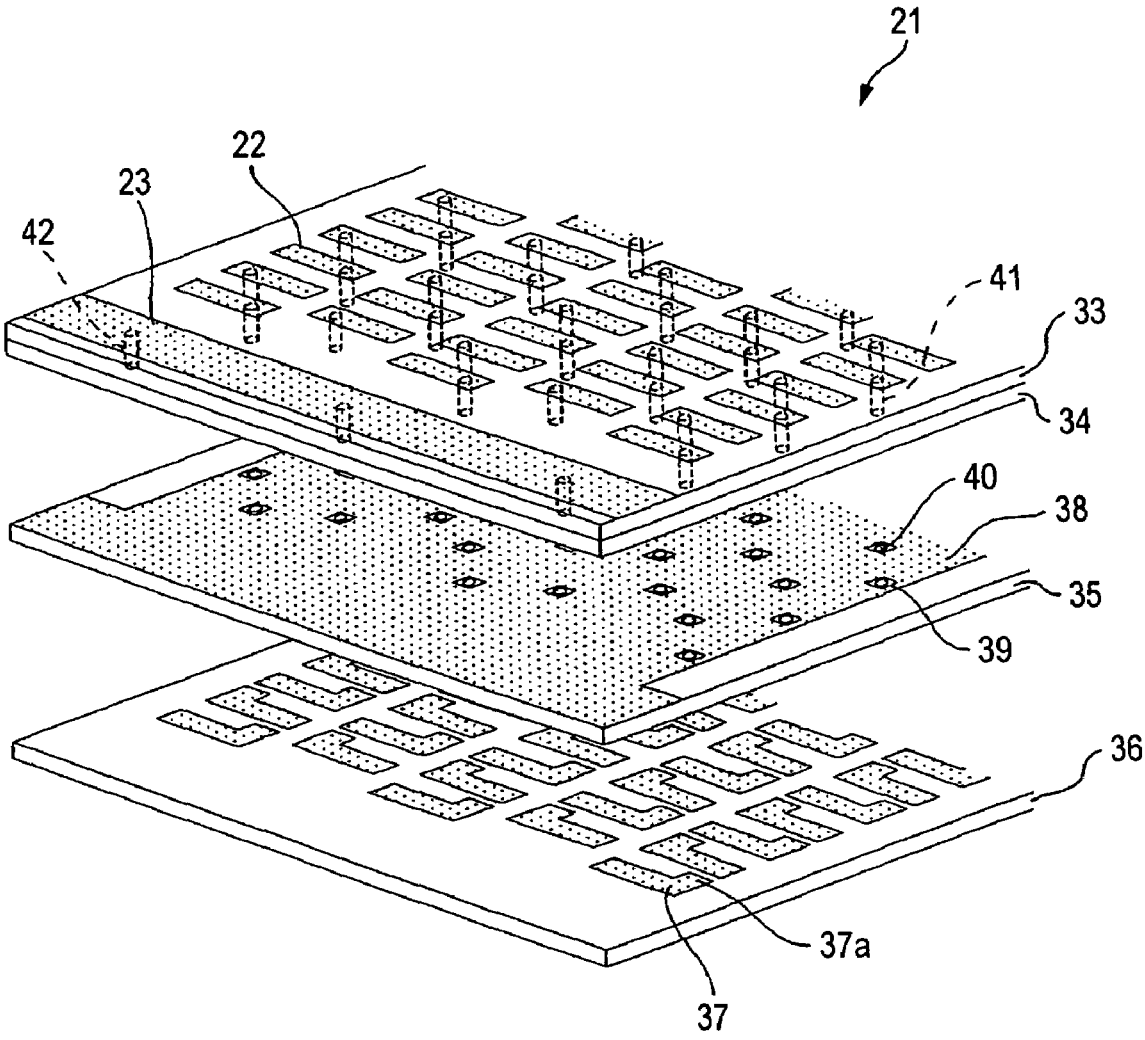
FIG. 6 is a main exploded perspective view of a piezoelectric actuator shown in FIG. 5.

FIG. 6 is a main exploded perspective view of the piezoelectric actuator 21 shown in FIG. 5. As shown in FIG. 6, the piezoelectric actuator 21 is formed by laminating two insulating sheets 33, 34 and two piezoelectric sheets 35, 36. On an upper surface of the piezoelectric sheet 36, plural individual electrodes 37 are formed so as to be placed as opposed to each of the pressure chambers 10 in the flow passage unit 27. These individual electrodes 37 are arranged in five rows of staggered shape along a longitudinal direction of the piezoelectric sheet 36 in correspondence with arrangement of the-pressure chambers 10. Each of the individual electrodes 37 is formed in elongated shape in a transverse direction of the piezoelectric sheet 36 as a whole. Also, each of the individual electrodes 37 has a drawing part 37*a* extending in the longitudinal direction of the piezoelectric sheet 36 from one end of the individual electrode 37. Incidentally, any drawing part 37*a* is drawn to a position opposed to a bulkhead for partitioning each of the pressure chambers 10.

A common electrode 38 astride plural pressure chambers 10 is disposed on an upper surface of the piezoelectric sheet 35. Plural non-formation regions 39 in which the common electrode 38 is not formed are formed on the upper surface of the piezoelectric sheet 35, and a hole 40 extending through a thickness direction of the piezoelectric sheet 35 is formed inside each of the non-formation regions 39. The non-formation regions 39 are formed in positions opposed to the drawing parts 37*a* of the corresponding individual electrodes 37.

Surface electrodes 22 corresponding to each of the plural individual electrodes 37 and a surface electrode 23 corresponding to the common electrode 38 are disposed on an upper surface (that is, an upper surface of the piezoelectric actuator 21) of the uppermost insulating sheet 33. The surface electrodes 22 are placed in positions opposed to the bulkheads for partitioning the pressure chambers 10 mutually, and are arranged in five rows of staggered shape along a longitudinal direction of the piezoelectric actuator 21 in correspondence with each of the individual electrodes 37. The surface electrode 23 extends along a transverse direction of the piezoelectric actuator 21 on one end of the insulating sheet 33.

In the insulating sheets 33, 34, plural continuous holes 41 extending through a thickness direction of the insulating sheets 33, 34 are formed in positions opposed to each of the holes 40 and regions opposed to the surface electrodes 22 and the drawing parts 37*a*. Plural through holes continuously extending through two insulating sheets 33, 34 and one piezoelectric sheet 35 are formed in the piezoelectric actuator 21 by laminating two insulating sheets 33, 34 and one piezoelectric sheet 35 with the holes 40 and the continuous holes 41 respectively aligned in this configuration. These through holes are filled with a conductive member in order to make electrical connection between the surface electrodes 22 and the individual electrodes 37 in the case of manufacturing the piezoelectric actuator 21. Also, in the insulating sheets 33, 34, three continuous holes 42 extending through the thickness direction of the insulating sheets 33, 34 are formed and separated along a transverse direction of the insulating sheets 33, 34 in regions opposed to the surface electrode 23 and the common electrode 38. These continuous holes 42 are also filled with a conductive member so as to make electrical connection between the surface electrode 23 and the common electrode 38 in the case of manufacturing the piezoelectric actuator 21.

By such a configuration, each of the individual electrodes 37 of the piezoelectric actuator 21 is connected to the driver IC 80 through the surface electrodes 22 and the individual wirings 73, and the common electrode 38 is connected to a ground through the surface electrode 23 and the common wiring 75. As a result of this, a driving voltage (driving signal) from the driver IC 80 can be applied between the common electrode 38 and any individual electrode 37 among each of the individual electrodes 37 of the piezoelectric actuator 21 while the common electrode 38 is set at a ground potential. Thus, distortion of a lamination direction is generated in an active part corresponding to a desired individual electrode 37 and ink is ejected from the nozzle 28 corresponding to this individual electrode 37 and thereby, predetermined printing on the sheet is done.

Figure 7:
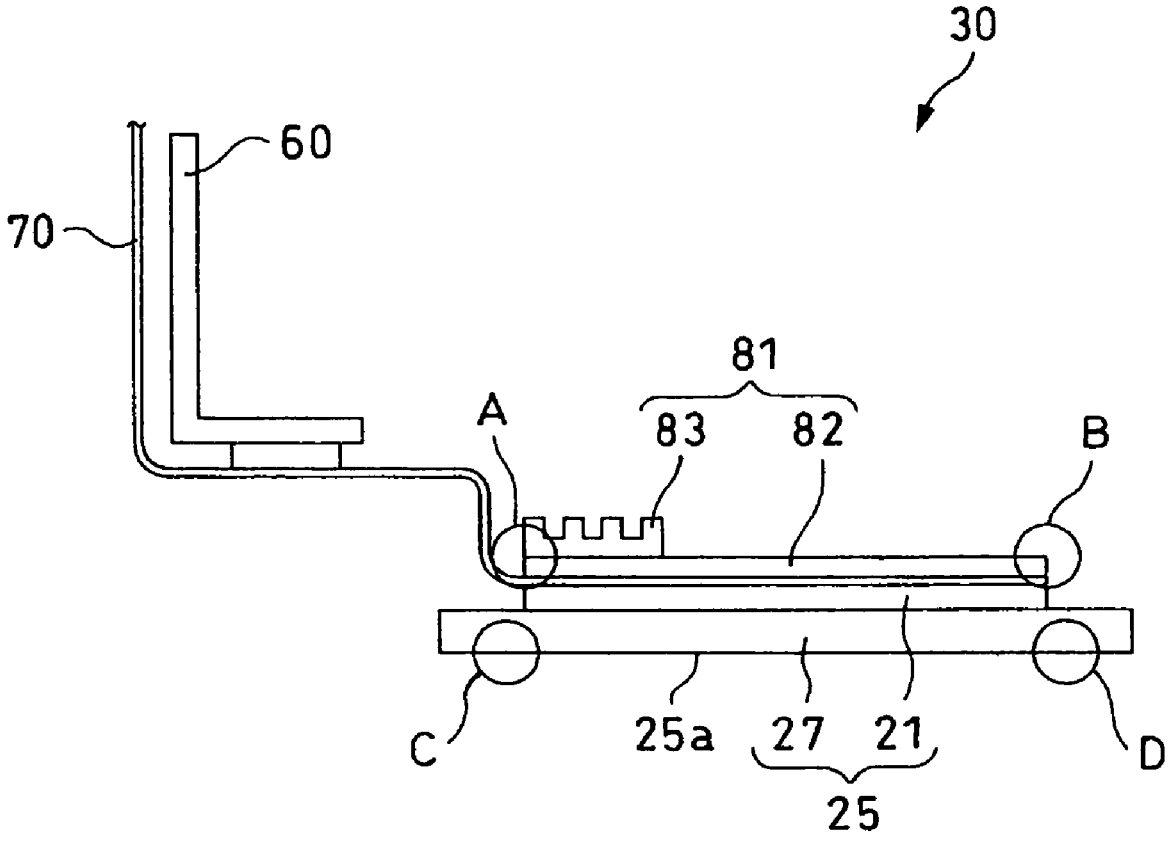
FIG. 7 is a schematic diagram showing a temperature measurement position of the ink-jet head.

Subsequently, a result of comparing a temperature difference in a predetermined position at the time of driving the ink-jet head 30 according to the aspect and an ink-jet head according to a comparative example on a predetermined driving condition will be described below. FIG. 7 is a schematic diagram showing a temperature measurement position of the ink-jet head. Incidentally, the ink-jet head according to the comparative example has a-configuration substantially similar to that of the ink-jet head 30, but a heat transfer body equivalent to the heat transfer body 81 is made of only the aluminum plate 82. Also, each of the ink-jet heads was driven on driving conditions that capacitance corresponding to one of the individual electrodes 37 in the piezoelectric actuator 21 is about 1500 pF and a driving voltage of each of the individual electrodes 37 is 28 V and a driving frequency is 24 KHz and driving duty is 11.1% and a driving signal for continuously ejecting three drops of ink simultaneously from all the nozzles (370 channels) is supplied for a predetermined time. The length (length of the sub-scanning direction) of the aluminum plate 82 at this time is 26 mm and the width (length of the main scanning direction) is 12 mm and the plate thickness is 1 mm and the surface area (excluding the area of a surface opposed to an upper surface of the piezoelectric actuator) is 388 $mm^2$. The length (length of the sub-scanning direction) of the bottom of the heat radiation body 83 is 19 mm and the width (length of the main scanning direction) of the bottom is 5.6 mm and the thickness of the bottom is 1.5 mm and the length protruding from the bottom of each of the protrusions 86 is 3 mm and the width (length of the main scanning direction) is 0.8 mm and the surface area (excluding the area of a portion joined to an upper surface of the aluminum plate 82) of the heat radiation body 83 is 655.4 $mm^2$. Also, the aluminum plate 82 and the heat radiation body 83 are made of the same aluminum and the thermal conductivity is 236 W/m×K.

Temperature measurement positions of each of the ink-jet heads are a region A near to the driver IC 80 of the aluminum plate 82 shown in FIG. 7 and a region B distant from the driver IC 80, and a region C of vicinity of the nozzle 28 near to the driver IC 80 of the nozzle surface 25*a* and a region D of vicinity of the nozzle 28 distant from the driver IC 80 of the nozzle surface 25*a*. Then, it is assumed that a temperature difference between the region A and the region B of the ink-jet head 30 is T1 and a temperature difference between the region C and the region D is T2 and a temperature difference between the region A and the region B of the ink-jet head according to the comparative example is T1' and a temperature difference between the region C and the region D is T2'. As a result of this, at a point in time when 37 seconds have elapsed since each of the ink-jet heads was driven, both of the temperature difference T1' and the temperature difference T2' were 0.3° C. in the comparative example, but both of the temperature difference T1 and the temperature difference T2 of the ink-jet head 30 were 0° C. Next, at a point in time when 70 seconds have elapsed since each of the ink-jet heads was driven, the temperature difference T1' was maintained at 0.3° C. and the temperature difference T2' increased to 0.5° C. On the other hand, the temperature difference T1 increased to 0.1° C. and the temperature difference T2 increased to 0.3° C. Then, at a point. in time when 103 seconds have elapsed since each of the ink-jet heads was driven, the temperature difference T1' increased to 0.4° C. and the temperature difference T2' increased to 0.7° C. On the other hand, the temperature difference T1 was maintained at 0.1° C. and the temperature difference T2 increased to 0.5° C.

It is apparent from the above result that the ink-jet head 30 of the aspect has a smaller temperature difference between the regions with different distances from the driver IC 80 in the nozzle surface 25*a* and the heat transfer body 81 than the ink-jet head of the comparative example at the time of driving in which the driver IC 80 generates heat. It is guessed that this is because the thickness of the heat transfer body 81 is thicker as the heat transfer body 81 is nearer to the driver IC 80 (the thickness of the heat transfer body 81 is thinner in a direction distant from the driver IC 80), that is, volume per unit area of the heat transfer body 81 becomes large in the region near to the driver IC 80 and heat capacity in the near region becomes larger than heat capacity in the distant region and thereby, time necessary to heat the region near to the driver IC 80 in the heat transfer body 81 becomes longer than that of the comparative example and thus, the temperature difference between the region near to the driver IC 80 and the region distant from the driver IC 80 is maintained small. In addition, it is guessed that the region near to the driver IC 80 becomes resistant to heating by this heat radiation body 83 because the heat transfer body 81 comprises the heat radiation body 83 in which the protrusions 86 are formed in the region near to the driver IC 80. In other words, by the heat radiation body 83, the surface area increases and heat radiation properties improve, so that the near region becomes more resistant to heating. As a result of this, the temperature difference between the near region and the distant region becomes smaller. Also, the temperature difference T2 of the ink-jet head 30 becomes smaller than the temperature difference T2' of the ink-jet head according to the comparative example. This is because heat of the flow passage unit 27 or the piezoelectric actuator 21 adjacent to the heat transfer body 81 is made uniform by the heat transfer body 81.

According to the ink-jet head 30 of the aspect as described above, when the heat transfer body 81 is heated by heat generation of the driver IC 80, the region of the heat transfer body 81 near to the driver IC 80 becomes more resistant to heating than the region of the heat transfer body 81 distant from the driver IC 80. As a result of that, the temperature difference between the regions with different distances from the driver IC 80 becomes small in the heat transfer body 81 as described above, so that an ink temperature difference between the pressure chambers 10 of the flow passage unit 27 adjacent to the heat transfer body 81 becomes small. This is because the heat transfer body 81 having heat uniformization action is placed in a position relatively adjacent to the plural pressure chambers 10. In addition, an ink temperature difference between the nozzles 28 of the flow passage unit 27 becomes small as described above. From the above description, variations in characteristics of ink eject from the nozzles 28 can be suppressed.

Also, the heat transfer body 81 is placed on the FPC 70 opposed to the piezoelectric actuator 21, so that a temperature difference between the individual electrodes 37 also becomes small. On the other hand, when a temperature difference between the individual electrodes 37 of the piezoelectric actuator 21 occurs, capacitance of a capacitor in which each of the individual electrodes is used as one electrode (the other electrode is used as a common electrode) differs, so that a different potential (driving signal) must be supplied to each of the individual electrodes 37 according to the capacitance. However, in the aspect, the temperature difference between the individual electrodes 37 is reduced by the heat transfer body 81, so that variations in ink eject characteristics between the nozzles can be suppressed even when the same potential is supplied to all the individual electrodes 37. Therefore, it becomes unnecessary to supply a different potential from the driver IC 80 to the individual electrodes 37 and control is simplified.

Also, the heat-radiation body 83 is disposed in the heat transfer body 81 and thereby, the amount of heat radiation from a surface of the heat transfer body 81 in the region near to the driver IC 80 becomes larger than that in the region distant from the driver IC 80 in the heat transfer body 81. As a result of that, the region near to the driver IC 80 becomes resistant to heating as described above. Therefore, the temperature difference between the region near to the driver IC 80 and the region distant from the driver IC 80 can be reduced further. Since four protrusions 86 are disposed in the heat radiation body 83, a surface area of the heat transfer body 81 can be increased easily. Also, the protrusions 86 upward protrude from the bottom (upper surface) of the heat radiation body 83, so that the protrusions 86 stay within a planar region of the aluminum plate 82. As a result of that, the ink-jet head 30 does not become large in a surface direction of an upper surface of the aluminum plate 82.

Figure 8:
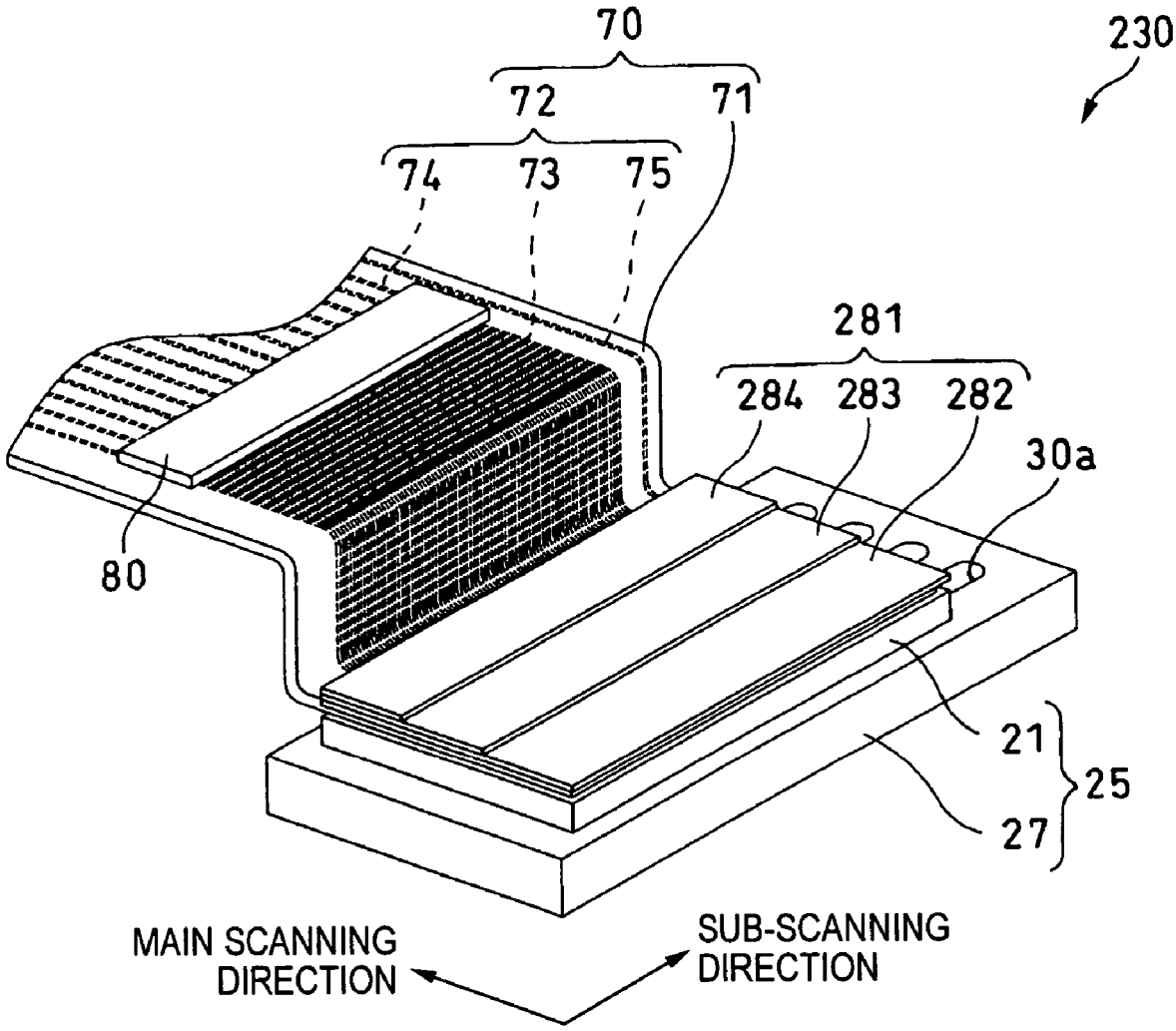
FIG. 8 is an outward appearance perspective view of an ink-jet head according to a second aspect of the invention.

Subsequently, an ink-jet head 230 according to a second aspect of the invention will be described below. FIG. 8 is an outward appearance perspective view of the ink-jet head 230 according to the second aspect of the invention. Incidentally, components similar to those of the ink-jet head 30 described above are shown by the same numerals and the description is omitted. As shown in FIG. 8, in the ink-jet head 230 in the present aspect, only a configuration of a heat transfer body 281 is somewhat different from that of the heat transfer body 81 described above and the other configuration has the same configuration as that of the ink-jet head 30 described above. The heat transfer body 281 is constructed by laminating three flat plates 282 to 284 having constant thickness, respectively. The flat plate 282 located in the lowermost layer among the three flat plates 282 to 284 is the same as the aluminum plate 82 described above, and is placed in a position opposed to a piezoelectric actuator 21. In the flat plate 283 laminated on an upper surface of the flat plate 282, the width about a main scanning direction is approximately two-thirds the width about the main scanning direction of the flat plate 282. Then, in the flat plate 284 laminated on an upper surface of the flat plate 283, the width about the main scanning direction is approximately one-third the width about the main scanning direction of the flat plate 282. All of these three flat plates 282 to 284 have the same length along a sub-scanning direction, and are placed so that the ends of the side of a driver IC 80 of each of the flat plates 282 to 284 overlap. That is, in the heat transfer body 281, all the cross sections along the main scanning direction have the same shape. Also, each of the flat plates 282 to 284 is constructed of aluminum.

Thus, a thickness of the heat transfer body 281 becomes thinner stepwise as the heat transfer body 281 is more distant from the driver IC 80. In other words, volume per unit area becomes larger stepwise as the heat transfer body 281 is nearer to the driver IC 80. As a result of this, a temperature difference among three regions, that is, a temperature difference among a region in which the three flat plates 282 to 284 are laminated, a region in which the two flat plates 282, 283 are laminated and a region in which only the flat plate 282 is present becomes relatively small in the heat transfer body 281 when the driver IC 80 generates heat in a manner similar to the heat transfer body 81 described above. As a result of this, effect similar to the first aspect can be obtained. In addition, the heat transfer body 281 has a simple configuration in which the three flat plates 282 to 284 are only laminated and joined mutually. Further, in the case of comparing the three regions of the heat transfer body 281, the surface area is larger as the region is nearer to the driver IC 80, so that the amount of heat radiation from a surface of the heat transfer body 281 also becomes larger as the region is nearer to the driver IC 80. As a result of that, the region becomes more resistant to heating as the region is nearer to the driver IC 80, and the temperature difference among the three regions of the heat transfer body 281 can be reduced further. Incidentally, in the heat transfer body 281, the region near to the driver IC 80 is a region in which the three flat plates 282 to 284 are laminated, and the region distant from the driver IC 80 is a region of the flat plates 282, 283 in which the flat plate 284 is not laminated. Also a thicknes of the heat transfer body 281 is constant (that is, a cross-sectional shape along the main scanning direction is constant) along a row direction (sub-scanning direction) of plural pressure chambers 10, so that ink temperatures between pressure chambers 10 and nozzles 28 become resistant to variation in the plural pressure chambers 10 and nozzles 28 along the sub-scanning direction. Also, the three flat plates 282 to 284 are formed of metal of the same kind, so that the heat transfer body 281 can be formed at low cost. As a result of that, cost of the ink-jet head 230 can be reduced.

Figure 9:
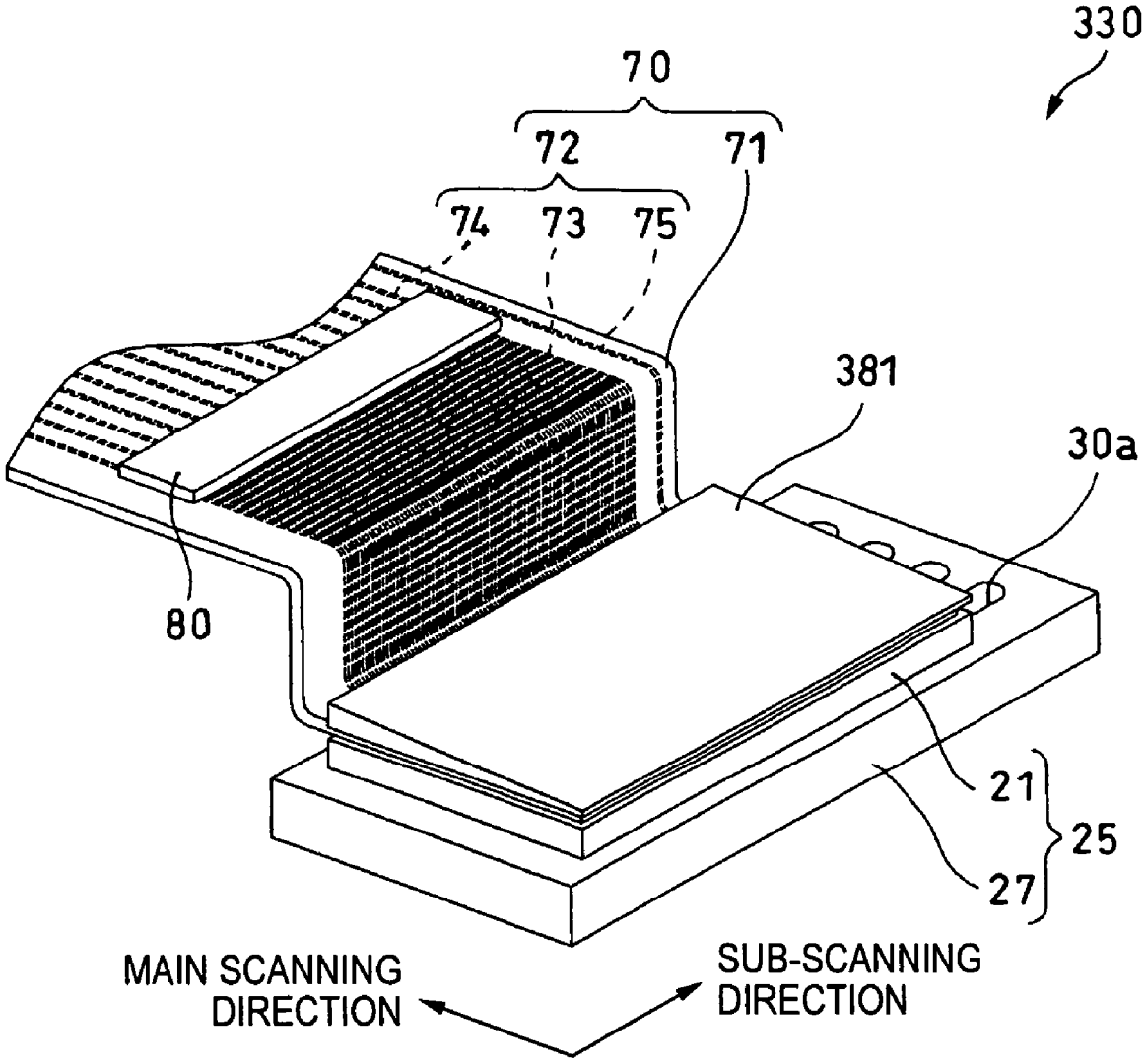
FIG. 9 is an outward appearance perspective view of an ink-jet head according to a third aspect of the invention.

Subsequently, an ink-jet head 330 according to a third aspect of the invention will be described below. FIG. 9 is an outward appearance perspective view of the ink-jet head 330 according to the third aspect of the invention. Incidentally, components similar to those of the ink-jet heads 30, 230 described above are shown by the same numerals and the description is omitted. As shown in FIG. 9, in the ink-jet head 330 in the present aspect, only a configuration of a heat transfer body 381 is somewhat different from that of the heat transfer bodies 81, 281 described above and the other configuration has the same configuration as that of the ink-jet heads 30, 230 described above. The heat transfer body 381 is made of a taper plate-shaped member in which the thickness becomes thinner as the heat transfer body 381 is more distant from a driver IC 80. The heat transfer body 381 has the same planar shape as the aluminum plate 82 described above, and is placed in a position opposed to a piezoelectric actuator 21. Also, the heat transfer body 381 extends along a sub-scanning direction so that a cross-sectional shape along a main scanning direction is constant. Thus, a thickness of the heat transfer body 381 becomes thinner gradually as the heat transfer body 381 is more distant from the driver IC 80. In other words, volume per unit area becomes larger gradually as the heat transfer body 381 is nearer to the driver IC 80. As a result of this, a temperature difference among regions with different distances from the driver IC 80 becomes relatively small when the driver IC 80 generates heat in a manner similar to the heat transfer bodies 81, 281 described above. As a result of this, effect similar to the first and second aspects can be obtained. Further, in the heat transfer body 381, the surface area is gradually larger as the region is nearer to the driver IC 80. This is because the surface area of the side increases by an increase in thickness. As a result of that, the amount of heat radiation from a surface of the heat transfer body 381 also becomes larger as the region is nearer to the driver IC 80. Therefore, the temperature difference among the regions with different distances from the driver IC 80 can be reduced further in a manner similar to the case described above. Incidentally, in the heat transfer body 381 of, the region near to the driver IC 80 is an end of the side of the driver IC 80 along the sub-scanning direction, and, the region distant from the driver IC 80 is a region other than the end of the heat transfer body 381. Also, a thickness of the heat transfer body 381 is constant along the sub-scanning direction, so that ink temperatures between pressure chambers 10 and nozzles 28 become resistant to variation in the plural pressure chambers 10 and nozzles 28 along the sub-scanning direction.

The aspects of the invention have been described above, but the invention is not limited to the aspects described above and various changes can be made within being described in the claims. For example, in each of the aspects described above, the heat transfer bodies 81, 281, 381 have been constructed of aluminum, but may be constructed of other metals. Also, when the heat transfer bodies 81, 281 are constructed of two or more members as shown in the first and second embodiments, materials constructing the respective bodies may be materials of different kinds. Also, the heat transfer bodies 81, 281, 381 could be placed so as to sandwich at least a part of the piezoelectric actuator 21 between the flow passage unit and the heat transfer bodies, and it is unnecessary to be opposed to all the upper surface of the piezoelectric actuator 21. Also, a length in a sub-scanning direction of the heat radiation body 83 may be set at the same length as that of a sub-scanning direction of the aluminum plate 82 to cover all the upper surface of the end of the side of the driver IC 80 of the aluminum plate 82. As a result of this, a thickness of the heat transfer body is constant along a row direction of plural pressure chambers 10, so that ink temperatures between the pressure chambers 10 and nozzles 28 become resistant to variation in the pressure chambers 10 and nozzles 28 within the same row. Also, the heat radiation body 83 has four protrusions 86, but the protrusion 86 may be one. Also, instead of the heat radiation body 83, the heat transfer body 81 may have at least one protrusion directly protruding from the aluminum plate 82 in the vicinity of the end of the side of the driver IC of the aluminum plate 82. Also, it is unnecessary for the protrusion 86 to extend continuously along a sub-scanning direction. Also, a protrusion of the heat transfer body 81 may protrude in a surface direction of the aluminum plate 82.

Also, the ink-jet heads 30, 230, 330 in each of the embodiments described above are applied to an ink-jet printer of a serial type, but the invention can also be applied to an ink-jet head applied to an ink-jet printer of a line type. Also, the ink-jet heads according to the embodiments described above are driven by the piezoelectric actuator of a piezoelectric method and ink is ejected from a nozzle, but the invention can also be applied to an ink-jet head of a thermal method in which ink of the inside of each of the pressure chambers is heated by a driving signal sent from the FPC and eject energy is transferred to the ink of the inside of the-pressure chambers. Also, in the head body 25, both of the plural pressure chambers 10 and nozzles 28 form five rows of pressure chambers and nozzles, but may be one row, respectively. In this case, the individual electrodes 37 of the piezoelectric actuator 21 become one row similarly.

What is claimed is:

1. An ink-jet head, comprising:

a flow passage unit having a plurality of nozzles and a plurality of pressure chambers respectively communicating with the nozzles, the pressure chambers being arranged along a planar surface of the flow passage unit;

an energy transfer unit which is fixed to the planar surface of the flow passage unit and transfers ejection energy to ink in the plurality of pressure chambers;

a driver IC which generates a driving signal supplied to the energy transfer unit;

a flat flexible cable in which the driver IC is mounted and a plurality of wirings that make connection between the driver IC and the energy transfer unit are formed; and a heat transfer body which sandwiches at least a part of the energy transfer unit between the heat transfer body and the planar surface of the flow passage unit, the heat transfer body having a thickness in a direction perpendicular to the planar surface, the thickness decreasing in a direction away from the driver IC.

2. The ink-jet head according to claim 1, wherein the heat transfer body includes a plurality of plates stacked to be placed in parallel with the planar surface.

3. The ink-jet head according to claim 2, wherein the plurality of plates are made of the same metal material.

4. The ink-jet head according to claim 1, wherein the plurality of nozzles and the plurality of pressure chambers are respectively arranged at least in a row in one direction, and the thickness of the heat transfer body is constant along the one direction.

5. The ink-jet head according to claim 1, wherein a surface area of the heat transfer body gradually decreases in the direction away from the driver IC.

6. The ink-jet head according to claim 5, wherein the heat transfer body includes at least one protrusion.

7. The ink-jet head according to claim 6, wherein the protrusion comprises a plurality of protrusions disposed at intervals in the direction away from the driver IC.

8. The ink-jet head according to claim 6, wherein the plurality of protrusions project from a bottom portion placed on the energy transfer unit.

9. The ink-jet head according to claim 6, wherein the protrusion is formed on a surface of the heat transfer body, the surface facing to the same direction as the planar surface of the flow passage unit.

10. The ink-jet head according to claim 1, wherein the energy transfer unit comprises a piezoelectric actuator which changes a volumetric capacity of the plurality of pressure chambers, and the piezoelectric actuator includes a plurality of individual electrodes opposed to each of the plurality of pressure chambers.

11. An image recording apparatus, comprising:

an ink cartridge; and an ink-jet head which comprises:

a flow passage unit having a plurality of nozzles and a plurality of pressure chambers respectively communicating with the nozzles the pressure chambers being arranged along a planar surface of the flow passage unit;

an energy transfer unit which is fixed to the planar surface of the flow passage unit and transfers ejection energy to ink in the plurality of pressure chambers;

a driver IC which generates a driving signal supplied to the energy transfer unit;

a flat flexible cable in which the driver IC is mounted and a plurality of wirings that make connection between the driver IC and the energy transfer unit are formed; and a heat transfer body which sandwiches at least a part of the energy transfer unit between the heat transfer body and the planar surface of the flow passage unit, the heat transfer body having a thickness in a direction perpendicular to the planar surface, the thickness decreasing in a direction away from the driver IC.

* * * * *